United States Patent [19]

Rosenbusch et al.

[11] 4,281,997

[45] Aug. 4, 1981

[54] PROCESS FOR THE GREASING OF LEATHER AND FUR SKINS

[75] Inventors: Kurt Rosenbusch, Frankfurt am Main; Merten Schlingmann, Königstein, both of Fed. Rep. of Germany

[73] Assignee: Hoechst Aktiengesellschaft, Frankfurt am Main, Fed. Rep. of Germany

[21] Appl. No.: 123,199

[22] Filed: Feb. 21, 1980

[30] Foreign Application Priority Data

Feb. 23, 1979 [DE] Fed. Rep. of Germany ..... 2907065

[51] Int. Cl.[3] ..... C14C 9/02

[52] U.S. Cl. ..... 8/94.1 P; 8/94.14; 8/94.23; 8/94.33; 260/920

[58] Field of Search ..... 8/94.1 P, 94.14, 94.23, 8/94.33

[56] References Cited

U.S. PATENT DOCUMENTS 4,018,559 4/1977 Retzsch ..... 8/94.1 P 4,134,867 1/1979 Topfi ..... 8/94.1 R 4,206,243 6/1980 Schlingmann et al. ..... 426/429

FOREIGN PATENT DOCUMENTS 857229 1/1978 Belgium .

OTHER PUBLICATIONS

Chemical Engineering, Jan. 7, 1974, pp. 62–63, "Protein from Methanol".

*Primary Examiner*—A. Lionel Clingman

*Attorney, Agent, or Firm*—Curtis, Morris & Safford

[57] ABSTRACT

Phospholipids which are obtained within the framework of protein synthesis from fermentatively produced constituents of micro-organisms may be used, following a conversion into a water-dilutable form, for example by emulsification or by a chemical modification, such as saponification or sulfonation, as greasing agents for the greasing of leather and fur skins. In this capacity they are superior to vegetable and animal phospholipids.

4 Claims, No Drawings

PROCESS FOR THE GREASING OF LEATHER AND FUR SKINS

Certain micro-organisms have the capacity to reproduce very rapidly in nutrient solutions containing organic substances and to build up their cell constituents, such as proteins, fats and nucleic acids, from the carbon of the organic substances and inorganic basic materials added, such as nitrogen, phosphoric acid, etc. Such micro-organisms are useful in the bioindustrial production of protein substances. For this purpose there may also be used synthetic nutrient media, if corresponding specialized micro-organisms are available.

Thus, for example, 1 kg of methanol-utilizing bacteria can produce 100 kg of monocellular protein per day from methanol, as carbon source, and a culture medium.

When decomposing the crude cellular mass obtained by means of the fermentative protein synthesis with a mixture of ammonia and methanol at 20° to 30° C., the proteid portion remains undissolved, whereas 8 to 10% of the cellular mass is dissolved in the form of lipid-like substances in the methanol/ammonia mixture.

After the evaporation of the above-mentioned solvent there remains a brown lipid extract which is insoluble in water and which consists of more than 60% phosholipids, and also contains triglyceride fats and free $C_{16}$-fatty acids. In contradistinction to vegetable and animal phosholipids, the phospholipids thus isolated and prepared in a fermentative-biosynthetic manner are insoluble in non-polar solvents.

It has now been found that these phospholipids obtained "biosynthetically" as by-products by means of single cell protein production are very good greasing agents for leather.

The subject of the present invention is a process for the greasing of a material which is a leather or fur skin or a dyed leather or fur skin, which comprises treating, by batchwise exhaustion, said material at a temperature below boiling point, preferably between 30° and 65° C., and at normal pressure, with a liquid formulation containing one or more phospholipids, obtained by methanol fermentation with bacteria of *Pseudo Monas* species or with *Methylomonas Clara* and subsequently emulsified in water or chemically modified by conversion of functional groups present in said phospholipid(s) into a water-solubilizing form or by introduction into the phospholipid of water-solubilizing groups, and then acidifying the treated material.

Like vegetable and animal lecithin, as it is found in egg oil or soy bean oil, the biosynthetic phospholipids—although showing a chemical structure different from that of native lecithin—have a softening and filling effect on leather which is superior to that of other known fatty substances. The favorable greasing effect of the natural lecithins of vegetable or animal oils has already been described many times, and use has been made thereof in the leather industry.

Surprisingly, these biosynthetic phospholipids prepared by way of fermentation are fixed on the leather fiber far more strongly than the natural lecithins obtained from egg oil or vegetable oils, in which lecithins the phosphate group bound to the glycerol radical as an ester has additionally been esterified with strongly cationic organic bases, for example choline (2-hydroxyethyl-trimethyl ammonium hydroxide $[(CH_3)_3N\text{-}CH_2\text{-}CH_2\text{-}OH]^+OH^-$), as is already known.

Normally, the lipids obtained by way of biosynthesis must be separated from the protein-containing main products, since they have a pulp-like smell and taste and thus would impair the protein obtained. Due to their impure form they may therefore not be considered for use in nutrition or animal feed. However, this pulpy smell does not present a problem in the greasing of leather, since the smell is neutralized by the leather fiber itself and the vegetable and mineral tanning agents employed.

For use as greasing agents, the phospholipid extracts isolated by the separation of protein and nucleic acids in the fermentative protein production must first be worked into a water-dilutable form.

To obtain an improved solubility of the phospholipids insoluble in water it is possible on the one hand to render the products emulsifiable in water according to the known methods of emulsion technology by adding anionic, cationic or non-ionic emulsifying agents. On the other hand, it is also possible to convert phospholipids into an actually water-soluble form, for example corresponding to the formula

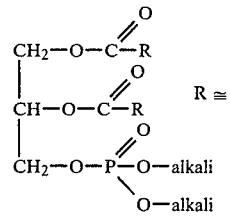

$R \cong C_{12}$, while exploiting the structural conditions given, especially the presence of the polyfunctional phosphoric acid esterified at the glycerol, by saponification while adding alkalis or lower organic bases.

Furthermore, the fatty radicals within the above-indicated glycerol derivative may also be chemically modified with sulfuric acid, oleum, amidosulfonic acid or other known sulfonating agents without splitting the triglyceride bond. The sulfo groups thus introduced render the phospholipid water-soluble in alkaline, neutral and acid media.

By adding from 0.5 to 10% of non-ionic stabilizing agents it is further possible to render the sulfonated phospholipids resistant to mineral salts, so that they may also be used directly in aqueous chromium(III)-salt tanning baths.

In the greasing of leather, the phospholipids prepared in a synthetic-fermentative manner prove to be clearly superior to the common vegetable and animal lecithin phospholipids with regard to their strong fixation to the leather fiber which is also resistant to dry cleaning.

As early as 1933 Professor Stather of Deutsches Lederinstitut (German leather institute) at Freiberg-/Sachsen reported the considerably lower fixation capacity of the egg yolk phospholipid fatty substances to chrome-tanned leather fibers as compared with the stronger fixation of sulfonated fish oils. He stated (Collegium 1933, page 139) that all of the yolk fat absorbed by the chrome-tanned leather can be extracted again in contrast with sulfonated fish oils and that there is no fixation of the former to the chrome-tanned leather fiber.

In contradistinction thereto, the phospholipid obtained biosynthetically-fermentatively is firmly fixed onto the leather fiber. Even with a prolonged extraction period, only a portion of about 30% of the total amount of fat absorbed by the leather may be removed from the leather. As may also be seen from Table 1 (cf. the Examples), about 70% of the bio-fats applied are firmly bound, whereas only about 20% (% of bound fat) of the vegetable or egg lecithins are bound.

As a result, leather greased in accordance with the invention remains soft and supple after dry cleaning and does not require any after-greasing—as is common in the case of other greasing agents—which may also be seen from the clearly lower difference values regarding the softness before and after dry cleaning.

This is why leather greased in this manner is particularly suitable for the manufacture of washable and dry cleaning-resistant glove and clothing leather, all the more since its shrinkage after cleaning is less than the shrinkage found with leather greased according to a different method. The leather retains its cut form as a ready-made article, and the dry cleaning process does not, by far, reduce the tensile strength values to the same extent as is the case with lecithin-greased leather.

The percentages (%) given in the above specification as well as in the following Examples relate to the weight, unless otherwise stated.

EXAMPLE 1

1000 Grams of a lipid-containing crude cellular protein mass obtained according to Chemical Engineering, 81/Jan. 7, 1974, pages 62–63, or German Auslegeschrift No. 26 33 666 with the aid of bacteria (*Pseudo Monas* Spez. or with *Methylomonas Clara*) from methanol (as carbon source) and consisting of 75% of crude protein, about 9% of phospholipids, 10% of nucleic acids, 5% of ashes and 1% of fibers, are split by being treated in 4 liters of a mixture of 400 g of aqueous ammonia (25% strength) and 3.6 l of methanol at room temperature within 20 minutes, and the degreased proteins remaining undissolved are filtered off via a vacuum filter. After eliminating the solvent by distallation, the methanol filtrate yields 90 g of a greenish brown lipid mass which consists of 75% of phospholipids, 3% of triglyceride fats and 15% of free fatty acids as well as 7% of lipoid compounds.

Both the esterified and the free fatty acids have a chain length of about $C_{16}$ for 95%.

EXAMPLE 2

70 Parts of the lipid fraction obtained according to Example 1 were mixed with 20 parts of a $C_{18}$-oxyethane-sulfonic acid and 10 parts of sodium carbonate and emulsified by means of 2 l of water of 70° C. Within 10 minutes the milky emulsion was introduced through the hollow shaft into a rotating greasing drum and applied onto moist box sides of a shaved weight of 2000 g having a thickness of 2 mm and being adjusted to a pH of 4.5. This corresponds to 4.5% of pure grease per shaved weight.

After a fulling period of 30 minutes at 50° C. the bath was acidified as usual by means of 2% of formic acid, in order to improve the bath exhaustion, and fulling was continued for another 15 minutes. After this time the total amount of fat from the aqueous bath had been absorbed by the leather.

For comparative data on the leathers see Table 1.

EXAMPLE 3

20 Parts of aqueous sodium hydroxide solution of 35% strength were added to 70 parts of the lipid fraction obtained according to Example 1, and the mixture was further diluted with 2 l of warm water. There was obtained a clear solution with a slight opalescence.

In a manner analogous to that of Example 2, this solution served to grease 2000 g of shaved box sides taken from the same part. However, in order to achieve the complete exhaustion of the bath, the amount of formic acid added was increased from 2% to 3.2% in this case.

For comparative data on the leathers see Table 1.

EXAMPLE 4

70 Parts of the lipid fraction obtained according to Example 1 were worked into an opal, turbid solution with 20 parts of triethanolamine and 2 l of warm water, and said solution was applied onto 2000 g of box sides in a manner analogous to that of Example 2.

For comparative data on the leathers see Table 1.

EXAMPLE 5

Within 15 minutes, a mixture of 15 g of concentrated sulfuric acid and 15 g of a mixture of 7 g of spindle mineral oil and a $C_{16}$-sulfonic acid was added to 60 parts of the lipid fraction obtained according to Example 1 in the stirring flask, in which process the temperature substantially increased. By way of external cooling the temperature was prevented from exceeding 60° C., so that the splitting of the triglyceride bond by the sulfuric acid was kept at the lowest possible level.

After a reaction period of 3 hours the excess sulfuric acid was washed out from the sulfonate paste by being treated twice, each time with 100 ml of saturated sodium chloride solution, and thereafter the paste was neutralized by adding 20 ml of 25% aqueous ammonia. In this manner there was obtained a brown paste which yielded a clear solution in water also in the slightly acid range of below pH 7.

In a manner analogous to that of Example 2, 2 kg of box sides were greased in the drum with the solution obtained above in the presence of 2 l of warm water.

For comparative data on the leathers see Table 1.

EXAMPLE 6

Comparative greasing:

70 Grams of a commercial soy bean lecithin (Oelmuehle Mannheim) were mixed with 20 parts of a $C_{18}$-oxyethane-sulfonic acid and 10 parts of sodium carbonate according to Example 2. The product was worked into an aqueous dispersion by means of 2 l of water, and said dispersion was applied to box sides as has been described in the Example cited.

For comparative data on the leathers see Table 1.

EXAMPLE 7

Comparative greasing:

70 Grams of pure egg lecithin (ERG.B.6-Merck, Darmstadt) were mixed with 20 parts of a $C_{18}$-oxyethanesulfonic acid and 10 parts of sodium carbonate in a manner analogous to that of Example 2. The product was worked into an aqueous dispersion by means of 2 l of water of 70° C., which dispersion was then applied onto 2 kg of chrome-tanned box sides as has been described in the Example cited.

For comparative data on the leathers see Table 1.

EXAMPLE 8

Comparative greasing:

As has been described in Example 2, 130 g of a 70% aqueous sulfonate paste prepared by the saponification of a paraffin hydrocarbon of a chain length of $C_{18}$ to $C_{22}$ having been sulfochlorinated to a content of 4.5 molar % were applied onto box sides, and the bath was exhausted with the aid of formic acid, as indicated in said Example.

For comparative data on the leathers see Table 1.

All leathers greased in accordance with Examples 2 to 8 were uniformly dried in an air drier at 50° C., sawdusted in a moist state as usual, staked and subsequently dried.

TABLE 1 to Patents Examples 2–8:
Condition of the greased box sides leather
(a) before dry cleaning
(b) after dry cleaning with a fluorinated chlorinated hydrocarbon

| Example | 2 | 3 | 4 | 5 | 6 | 7 | 8 |
|---|---|---|---|---|---|---|---|
| Grain appearance | (a) supple<br>(b) supple | somewhat drier<br>unchanged | supple<br>supple | supple<br>supple | supple<br>dry | supple<br>dry | supple<br>supple |
| Grain structure | (a) fine grain<br>(b) fine grain | trace of broad grain<br>unchanged | fine grain<br>fine grain | fine grain<br>fine grain | fine grain<br>broad grain | fine grain<br>coarse grain | broad grain<br>broad grain |
| Fullness (scale with increasing fullness 1–10) | (a) 7<br>(b) 7 | (a) 8<br>(b) 8 | (a) 8<br>(b) 7 | (a) 9<br>(b) 8 | (a) 7<br>(b) 5 | (a) 8<br>(b) 5 | (a) 6<br>(b) 5 |
| Leather softness in acc/w Stirley stiffness tester (1 = max. softness, 8 = max. hardness) | (a) 3.4<br>(b) 3.6 | (a) 2.7<br>(b) 3.0 | (a) 2.1<br>(b) 2.5 | (a) 2.5<br>(b) 2.8 | (a) 3.5<br>(b) 5.8 | (a) 3.2<br>(b) 6.4 | (a) 4.7<br>(b) 6.0 |
| % of extractable fat* (methylenechloride/ Soxhlet) | (a) 3.8<br>(b) 1.4 | (a) 3.0<br>(b) 1.55 | (a) 2.7<br>(b) 1.3 | (a) 3.9<br>(b) 1.6 | (a) 7.9<br>(b) 0.9 | (a) 9.1<br>(b) 1.3 | (a) 6.7<br>(b) 1.1 |
| % of bound fat** | (a) 6.4<br>(b) 6.1 | (a) 6.0<br>(b) 5.7 | (a) 6.8<br>(b) 6.1 | (a) 5.3<br>(b) 5.0 | (a) 2.0<br>(b) 1.9 | (a) 1.7<br>(b) 1.7 | (a) 3.4<br>(b) 2.8 |
| Tensile strength kg/cm$^3$ | (a) 270<br>(b) 290 | (a) 240<br>(b) 230 | (a) 235<br>(b) 242 | (a) 282<br>(b) 262 | (a) 265<br>(b) 202 | (a) 295<br>(b) 222 | (a) 220<br>(b) 225 |
| % of elongation at break | (a) 40<br>(b) 38 | (a) 51<br>(b) 44 | (a) 58<br>(b) 52 | (a) 48<br>(b) 40 | (a) 43<br>(b) 34 | (a) 31<br>(b) 37 | (a) 54<br>(b) 54 |

*(a) value corrected by deducting 0.36% of natural fat of ungreased leathers (extractable)
**(a) and (b) values corrected by deducting 0.84% of non-extractable bound natural fat of the skins

What is claimed is:

1. A process for greasing a material which is a leather or fur skin or a dyed leather or fur skin, which comprises treating, by batchwise exhaustion, said material at a temperature below boiling point and at normal pressure with a liquid formulation containing one or more phospholipids, each obtained by methanol fermentation with bacteria of *Pseudo Monas* species or with *Methylomonas Clara* and subsequently emulsified in water or chemically modified by conversion of functional groups present in said phospholipid into a water-solubilizing form or by introduction into the phospholipid of water-solubilizing groups, and then acidifying the treated material.

2. A process as claimed in claim 1, wherein the liquid formulation contains one or more phospholipids converted into a water-dilutable form by means of an anionic, cationic or nonionic emulsifying agent.

3. A process as claimed in claim 1, wherein the liquid formulation contains one or more phospholipids converted into a water-dilutable form by way of saponification.

4. A process as claimed in claim 1, wherein the liquid formulation contains one or more phospholipids converted into a water-dilutable form by way of sulfonation.

* * * * *